US009291078B2

(12) United States Patent
Wi et al.

(10) Patent No.: US 9,291,078 B2
(45) Date of Patent: Mar. 22, 2016

(54) HYDRAULIC PRESSURE SUPPLY SYSTEM OF AUTOMATIC TRANSMISSION

(71) Applicant: Hyundai Motor Company, Seoul (KR)

(72) Inventors: Taehwan Wi, Bucheon-si (KR); Jin Young Hwang, Busan (KR); Se Hwan Jo, Bucheon-si (KR)

(73) Assignee: Hyundai Motor Company, Seoul (KR)

( * ) Notice: Subject to any disclaimer, the term of this patent is extended or adjusted under 35 U.S.C. 154(b) by 362 days.

(21) Appl. No.: 13/712,824

(22) Filed: Dec. 12, 2012

(65) Prior Publication Data

US 2014/0060679 A1 Mar. 6, 2014

(30) Foreign Application Priority Data

Sep. 3, 2012 (KR) ..... 10-2012-0097303

(51) Int. Cl.

| | |
|---|---|
| ***F01M 1/02*** | (2006.01) |
| ***F04B 23/04*** | (2006.01) |
| ***F01M 1/16*** | (2006.01) |
| *F01M 1/12* | (2006.01) |

(52) U.S. Cl.

CPC . *F01M 1/02* (2013.01); *F01M 1/16* (2013.01); *F04B 23/04* (2013.01); *F01M 2001/123* (2013.01); *Y10T 137/86139* (2015.04)

(58) Field of Classification Search

CPC ..... F01M 1/02; F01M 1/16; F01M 2001/123; Y02T 10/76; F16H 57/0401; F16H 2047/025; F16H 204/045; F16H 57/0441; F04B 23/04

USPC ..... 417/278, 302, 307, 308, 364, 410.1, 417/440, 505; 123/1 A, 196 R, 196 S, 196 V, 123/196 W, 197.1, 198 P; 137/565.3, 137/565.33, 565.35

See application file for complete search history.

(56) References Cited

U.S. PATENT DOCUMENTS

| | | | | |
|---|---|---|---|---|
| 5,217,085 | A * | 6/1993 | Barrie et al. | 184/104.1 |
| 5,875,865 | A * | 3/1999 | Wakahara et al. | 180/248 |
| 6,196,806 | B1 | 3/2001 | Van Der Sluis | |

(Continued)

FOREIGN PATENT DOCUMENTS

| | | |
|---|---|---|
| JP | 3691469 B2 | 6/2005 |
| JP | 2009-52638 A | 3/2009 |

(Continued)

*Primary Examiner* — Justin Jonaitis
*Assistant Examiner* — Stephen Mick
(74) *Attorney, Agent, or Firm* — Morgan, Lewis & Bockius LLP

(57) ABSTRACT

A hydraulic pressure supply may include a low pressure portion, a high pressure portion, a low-pressure hydraulic pump receiving the oil stored in the oil pan and discharging the low hydraulic pressure to a first low-pressure line fluid-connected to the low-pressure hydraulic pump, a switch valve fluid-connected to the first low-pressure line, and selectively supplying the low hydraulic pressure to the low pressure portion or the high pressure portion, a low-pressure regulator valve connected to the switch valve, a high-pressure hydraulic pump fluid-connected to the low-pressure hydraulic pump through the first low-pressure line, a high-pressure regulator valve fluid-connected to the high pressure line and controlling the high hydraulic pressure supplied from the high-pressure hydraulic pump and the low hydraulic pressure supplied from the low-pressure hydraulic pump to be stable high hydraulic pressure, a second input line connecting the oil pan to the first low-pressure line.

12 Claims, 2 Drawing Sheets

(56) References Cited

U.S. PATENT DOCUMENTS

| | | | | |
|---|---|---|---|---|
| 6,523,519 | B2 | 2/2003 | Iwano et al. | |
| 6,923,091 | B2 * | 8/2005 | Hori et al. | 74/606 R |
| 6,941,922 | B2 * | 9/2005 | Williams et al. | 123/196 R |
| 7,331,323 | B2 * | 2/2008 | Hara | 123/196 A |
| 2006/0065217 | A1 * | 3/2006 | Ikegawa | 123/41.42 |
| 2008/0308355 | A1 * | 12/2008 | Kakinami et al. | 184/27.2 |
| 2009/0082153 | A1 * | 3/2009 | Fujikawa et al. | 475/128 |

FOREIGN PATENT DOCUMENTS

| | | | |
|---|---|---|---|
| KR | 10-2007-0057833 | A | 6/2007 |
| KR | 10-2012-0037623 | A | 4/2012 |

* cited by examiner

HYDRAULIC PRESSURE SUPPLY SYSTEM OF AUTOMATIC TRANSMISSION

CROSS-REFERENCE TO RELATED APPLICATION

The present application claims priority to Korean Patent Application No. 10-2012-0097303 filed on Sep. 3, 2012, the entire contents of which is incorporated herein for all purposes by this reference.

BACKGROUND OF THE INVENTION

1. Field of the Invention

The present invention relates to a hydraulic pressure supply system of an automatic transmission for a vehicle. More particularly, the present invention relates to a hydraulic pressure supply system of an automatic transmission for a vehicle which can improve safety and reliability as a consequence that the automatic transmission can be operated normally using hydraulic pressure of a low-pressure hydraulic pump when a high-pressure hydraulic pump is stopped.

2. Description of Related Art

Recently, vehicle makers direct all their strength to improve fuel economy due to worldwide high oil prices and strengthen of exhaust gas regulations.

Improvement of fuel economy may be achieved by improving power delivery efficiency in an automatic transmission, and improvement of the power delivery efficiency may be achieved by minimizing unnecessary power consumption of a hydraulic pump.

A recent automatic transmission is provided with a low-pressure hydraulic pump and a high-pressure hydraulic pump so as to improve fuel economy. Therefore, hydraulic pressure generated by the low-pressure hydraulic pump is supplied to a low pressure portion (i.e., a torque converter, a cooling device, and a lubrication device), and hydraulic pressure generated by the high-pressure hydraulic pump is supplied to a high pressure portion (i.e., friction members selectively operated when shifting).

In further detail, general hydraulic pressure of the automatic transmission is generated for the low pressure portion (i.e., generated by the low-pressure hydraulic pump), and hydraulic pressure demanded by the high pressure portion is generated by the high-pressure hydraulic pump and then is supplied to the high pressure portion.

Since power consumption for driving the hydraulic pumps can be minimized, fuel economy may be enhanced. In addition, since a load applied to the hydraulic pumps is reduced, noise and vibration may be reduced and durability may be improved.

Since hydraulic pressure generated by the low-pressure hydraulic pump is supplied to the high-pressure hydraulic pump and the high hydraulic pressure is generated by the high-pressure hydraulic pump according to a conventional hydraulic pressure supply system, the hydraulic pressure supplied to the high pressure portion is insufficient and vehicle cannot drive if the high-pressure hydraulic pump is out of order.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a hydraulic pressure supply system of an automatic transmission for a vehicle having advantages of improving safety and reliability when a high-pressure hydraulic pump is out of order or is stopped as a consequence of normally operating the hydraulic pressure supply system only by using hydraulic pressure of a low-pressure hydraulic pump.

A hydraulic pressure supply system of an automatic transmission for a vehicle which generates low hydraulic pressure and high hydraulic pressure using oil stored in an oil pan and supplies the low hydraulic pressure and the high hydraulic pressure respectively to a low pressure portion and a high pressure portion, may include a low-pressure hydraulic pump receiving the oil stored in the oil pan through a first input line, generating the low hydraulic pressure, and discharging the low hydraulic pressure to a first low-pressure line fluid-connected to the low-pressure hydraulic pump, a switch valve fluid-connected to the first low-pressure line, and selectively supplying the low hydraulic pressure supplied from the first low-pressure line to the low pressure portion or the high pressure portion, wherein the low pressure portion and the high pressure portion are connected to the switch valve, a low-pressure regulator valve fluid-connected to the switch valve through a second low-pressure line and controlling the low hydraulic pressure supplied from the switch valve through the second low-pressure line to be stable low hydraulic pressure, and supplying the stable hydraulic pressure to the low pressure portion through a third low-pressure line fluid-connecting the low-pressure regulator valve and the low pressure portion, a high-pressure hydraulic pump fluid-connected to the low-pressure hydraulic pump through the first low-pressure line and increasing the low hydraulic pressure supplied from the low-pressure hydraulic pump through the first low-pressure line to be the high hydraulic pressure, and discharging the high hydraulic pressure to a high-pressure line fluid-connected to the high pressure portion, a high-pressure regulator valve fluid-connected to the high pressure line and controlling the high hydraulic pressure supplied from the high-pressure hydraulic pump through the high-pressure line and the low hydraulic pressure supplied from the low-pressure hydraulic pump through the switch valve to be stable hydraulic pressure, and supplying the stable hydraulic pressure to the high pressure portion, and a second input line connecting the oil pan to the first low-pressure line.

The low-pressure hydraulic pump is a mechanical hydraulic pump driven by an engine, and the high-pressure hydraulic pump is an electric hydraulic pump driven by an electric motor.

The switch valve is controlled by control pressure of a first solenoid valve being an on/off solenoid valve.

The switch valve is provided with one inflow port and two outflow ports, and is configured to selectively supply the low hydraulic pressure supplied to the inflow port to any one of the two outflow ports.

The one inflow port is fluid-connected to the first low pressure line and each of the two outflow ports is fluid-connected to the second low pressure line and the high pressure line respectively.

The low-pressure regulator valve recirculates through a first recirculation line a portion of the low hydraulic pressure supplied from the first low-pressure line so as to control the low hydraulic pressure of the first low-pressure line to be the stable low hydraulic pressure, and supplies the stable low hydraulic pressure to the second low-pressure line.

The first recirculation line fluid-connects the low-pressure regulator valve with the first input line.

The low-pressure regulator valve is controlled by elastic force of an elastic member disposed at a side thereof and the low hydraulic pressure of the second low-pressure line supplied to the other side thereof.

The high-pressure regulator valve is selectively connected to the first low-pressure line through the switch valve and is directly connected to the high-pressure line, wherein the high-pressure regulator valve supplies through a supply line a portion of the low hydraulic pressure supplied from the first low-pressure line or the high hydraulic pressure from the high-pressure line.

The high-pressure regulator valve and the switch valve are fluid-connected by the high pressure line.

The supply line fluid-connects the high-pressure regulator valve with the third low-pressure line.

The high-pressure regulator valve is controlled by control pressure of a second solenoid valve, elastic force of an elastic member, and the low hydraulic pressure of the first low-pressure line or the high hydraulic pressure of the high-pressure line so as to counteract the control pressure of the second solenoid valve.

The second solenoid valve is a proportional control solenoid valve.

A check valve for preventing back flow is mounted on the second input line.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
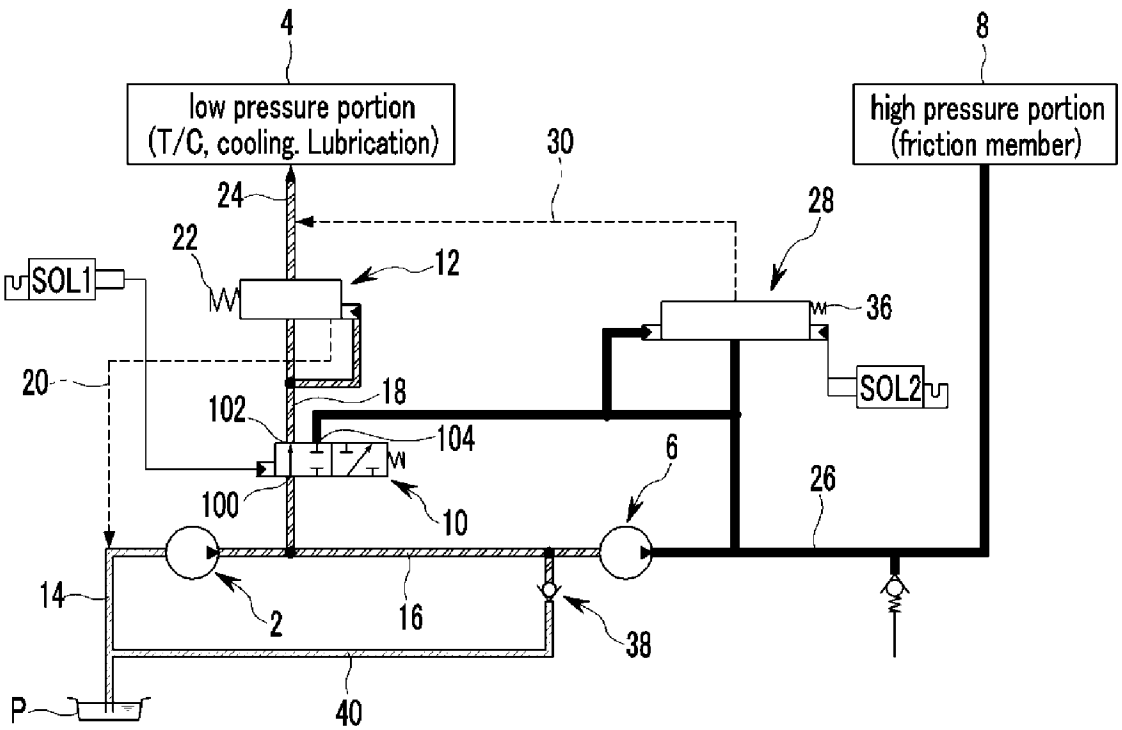
FIG. 1 is a schematic diagram of a hydraulic pressure supply system according to an exemplary embodiment of the present invention when a low-pressure hydraulic pump and a high-pressure hydraulic pump are operated normally.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

Description of components that are not necessary for explaining the present exemplary embodiment will be omitted, and the same constituent elements are denoted by the same reference numerals in this specification.

In the detailed description, ordinal numbers are used for distinguishing constituent elements having the same terms, and have no specific meanings.

FIG. 1 is a schematic diagram of a hydraulic pressure supply system according to an exemplary embodiment of the present invention when a low-pressure hydraulic pump and a high-pressure hydraulic pump are operated normally.

Referring to FIG. 1, a hydraulic pressure supply system according to an exemplary embodiment of the present invention is adapted to supply low hydraulic pressure generated by a low-pressure hydraulic pump 2 to a low pressure portion 4 such as a torque converter (T/C), a cooling portion, a lubrication portion and to supply high hydraulic pressure generated by a high-pressure hydraulic pump 6 to a high pressure portion 8 for operating friction members related to shifting.

The low hydraulic pressure is a lower pressure facilitating operation of the torque converter (T/C) and cooling and lubrication, and the high hydraulic pressure is a high pressure facilitating operation of a plurality of friction members.

The low hydraulic pressure is generated by the low-pressure hydraulic pump 2 and is supplied to the low pressure portion 4 through a switch valve 10 and a low-pressure regulator valve 12.

The low-pressure hydraulic pump 2, as is well known to a person of an ordinary skill in the art, is a mechanical pump driven by torque of an engine. The low-pressure hydraulic pump 2 is connected to an oil pan P through a first input line 14 and discharges the low hydraulic pressure generated by the low-pressure hydraulic pump 2 to a first low-pressure line 16.

The switch valve 10 may be a spool valve, and is adapted to be controlled by a first solenoid valve SOL1 that is on/off-controlled and to deliver the hydraulic pressure of the first low-pressure line 16 selectively to the low-pressure regulator valve 12 or the high pressure portion 8.

For this purpose, the switch valve 10 is provided with one inflow port 100 and two outflow ports 102 and 104. The inflow port 100 is connected to the first low-pressure line 16, a first outflow port 102 is connected to the low-pressure regulator valve 12, and a second outflow port 104 is connected to the high pressure portion 8.

The low-pressure regulator valve 12 is connected to the switch valve 10 through a second low-pressure line 18 and is connected to the first input line 14 through a first recirculation line 20. Therefore, the low-pressure regulator valve 12 recirculates a portion of the low hydraulic pressure supplied from the switch valve 10 to the first input line 14 through the first recirculation line 20 so as to control the hydraulic pressure.

That is, the low-pressure regulator valve 12 is controlled by elastic force of an elastic member 22 disposed at a side thereof and the hydraulic pressure of the second low-pressure line 18 supplied to the opposite side of the elastic member 22 so as to control the hydraulic pressure. The hydraulic pressure controlled by the low-pressure regulator valve 12 is supplied to the low pressure portion 4 through a third low-pressure line 24. The elastic force of the elastic member 22 is set according to the hydraulic pressure demanded by the low pressure portion 4.

The high-pressure hydraulic pump 6 may be an electric pump driven by an electric motor. In addition, the high-pressure hydraulic pump 6 increases the low hydraulic pressure supplied through the first low-pressure line 16 to the high hydraulic pressure and discharges the high hydraulic pressure to a high-pressure line 26. In addition, the hydraulic pressure discharged from the high-pressure hydraulic pump 6 to the high-pressure line 26 is controlled to stable high hydraulic pressure at a high-pressure regulator valve 28, and the stable high hydraulic pressure is supplied to the high pressure portion 8.

The high-pressure regulator valve 28 is connected to the high-pressure line 26 and is connected to the third low-pressure line 24 through a supply line 30. Therefore, the high-pressure regulator valve 28 supplies a portion of the hydraulic pressure supplied through the high-pressure line 26 to the third low-pressure line 24 through the supply line 30 so as to control the hydraulic pressure.

For this purpose, the high-pressure regulator valve 28 may be a conventional spool valve. In addition, the high-pressure regulator valve 28 is controlled by control pressure of a second solenoid valve SOL2 performing proportional control, elastic force of an elastic member 36, and the hydraulic pressure of the high-pressure line 26 counteracting the control pressure of the second solenoid valve SOL2. The elastic force of the elastic member 36 is set according to the hydraulic pressure demanded by the high-pressure line 26.

The supply line 30 is connected to the third low-pressure line 24 so as to supply the hydraulic pressure to the low pressure portion 4 when only the high-pressure hydraulic pump 6 is operated.

In addition, the high-pressure hydraulic pump 6 is connected to the oil pan P through a second input line 40. A check valve 38 for preventing back flow is disposed on the second input line 40. Therefore, the high-pressure hydraulic pump 6 directly receives the oil from the oil pan P so as to generate the high hydraulic pressure when the hydraulic pressure is not supplied from the low-pressure hydraulic pump 2 to the high-pressure hydraulic pump 6.

When the low-pressure hydraulic pump 2 and the high-pressure hydraulic pump 6 are operated normally, the hydraulic pressure supply system according to an exemplary embodiment of the present invention supplies the low hydraulic pressure generated by the low-pressure hydraulic pump 2 to the low pressure portion 4 and supplies the high hydraulic pressure generated by the high-pressure hydraulic pump 6 to the high pressure portion 8, as shown in FIG. 1.

At this time, the first solenoid valve SOL1 is switched on, and the low hydraulic pressure generated by the low-pressure hydraulic pump 2 is supplied to the low-pressure regulator valve 12 through the switch valve 10 so as to be the stable low hydraulic pressure. In addition, the high hydraulic pressure generated by the high-pressure hydraulic pump 6 is controlled to be the stable high hydraulic pressure by the high-pressure regulator valve 28 that is controlled by the second solenoid valve SOL2.

Figure 2:
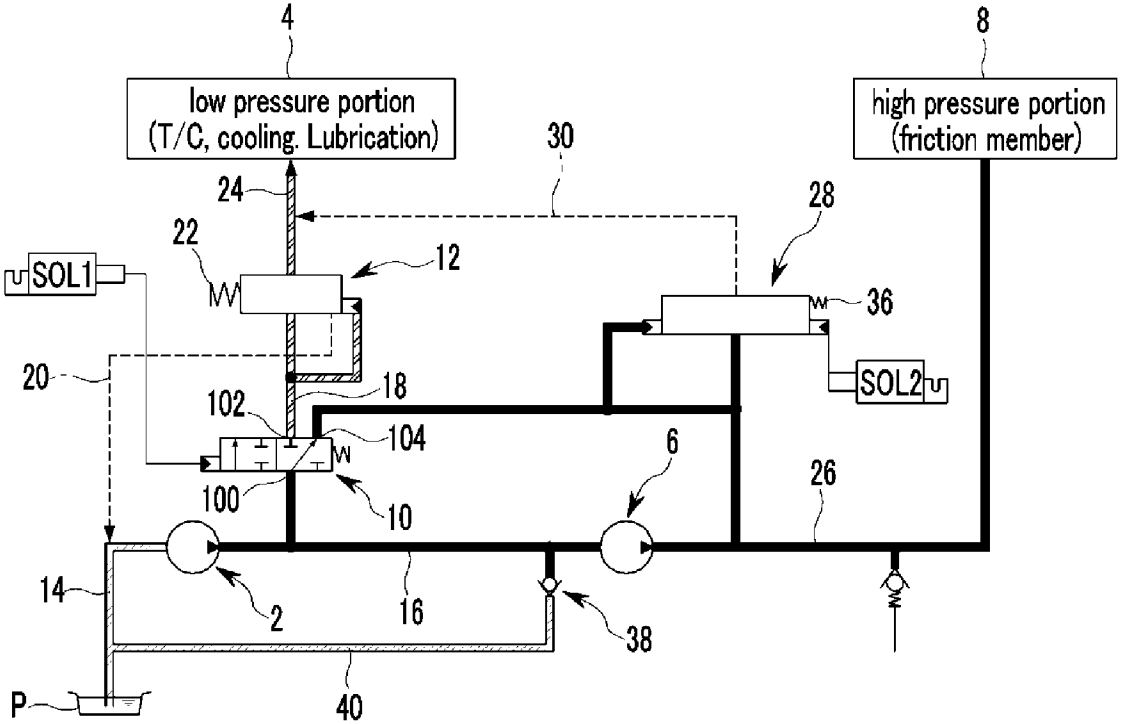
FIG. 2 is a schematic diagram of a hydraulic pressure supply system according to an exemplary embodiment of the present invention when a high-pressure hydraulic pump is operated abnormally.

FIG. 2 is a schematic diagram of a hydraulic pressure supply system according to an exemplary embodiment of the present invention when a high-pressure hydraulic pump is operated abnormally.

That is, oil flow when the high-pressure hydraulic pump 6 is not operated due to failure or lack of power in a battery is illustrated in FIG. 2. In this case, the first solenoid valve SOL1 is switched off.

At this time, the hydraulic pressure generated by the low-pressure hydraulic pump 2 is supplied to the high-pressure line 26 by conversion of hydraulic line in the switch valve 10. The hydraulic pressure supplied to the high-pressure line 26 is controlled to be the high hydraulic pressure by control of the high-pressure regulator valve 28 and is then supplied to the high pressure portion 8. Therefore, the high pressure portion 8 can be operated smoothly.

Since the hydraulic pressure supply system is operated normally using the low-pressure hydraulic pump 2 when the high-pressure hydraulic pump 6 is not operated, safety and reliability of the hydraulic pressure supply system having two hydraulic pumps 2 and 6 may be improved.

Particularly, when the vehicle provided with the ISG system is stopped temporarily, the high hydraulic pressure may be supplied to the high pressure portion 8 in a state of engine stop. At this time, the high-pressure hydraulic pump 6 is operated so as to pump the oil in the oil pan P through the second input line 40 and generate the high hydraulic pressure. Therefore, the preparatory hydraulic pressure can be supplied to the high pressure portion 8.

That is, although the engine is stopped and the low-pressure hydraulic pump 2 is not operated, the high hydraulic pressure can be supplied to the high pressure portion 8 by operation of the high-pressure hydraulic pump 6.

According to an exemplary embodiment of the present invention, the low-pressure hydraulic pump 2 generates the low hydraulic pressure and the high-pressure hydraulic pump 6 generates the high hydraulic pressure by increasing the hydraulic pressure supplied from the low-pressure hydraulic pump 2. Therefore, power loss of the hydraulic pumps may be minimized, durability may be improved, noise and vibration of the hydraulic pumps may be reduced.

In addition, the hydraulic pressure supply system can be operated normally using the low-pressure hydraulic pump 2 when the high-pressure hydraulic pump 6 is not operated. Therefore, stability and reliability may be enhanced.

In addition, since the high-pressure hydraulic pump 6 can generate the high hydraulic pressure independently, the system may be applied to the vehicle having the ISG system.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A hydraulic pressure supply system of an automatic transmission for a vehicle which generates low hydraulic pressure and high hydraulic pressure using oil stored in an oil pan and supplies the low hydraulic pressure and the high hydraulic pressure respectively to a low pressure portion and a high pressure portion, the hydraulic pressure supply system comprising:

a low-pressure hydraulic pump receiving the oil stored in the oil pan through a first input line, generating the low hydraulic pressure, and discharging the low hydraulic pressure to a first low-pressure line fluid-connected to the low-pressure hydraulic pump;

a switch valve fluid-connected to the first low-pressure line, and selectively supplying the low hydraulic pressure supplied from the first low-pressure line to the low pressure portion or the high pressure portion, wherein the low pressure portion and the high pressure portion are connected to the switch valve;

a low-pressure regulator valve fluid-connected to the switch valve through a second low-pressure line and controlling the low hydraulic pressure supplied from the switch valve through the second low-pressure line to be stable low hydraulic pressure, and supplying the stable hydraulic pressure to the low pressure portion through a third low-pressure line fluid-connecting the low-pressure regulator valve and the low pressure portion;

a high-pressure hydraulic pump fluid-connected to the low-pressure hydraulic pump through the first low-pressure line and increasing the low hydraulic pressure supplied from the low-pressure hydraulic pump through the first low-pressure line to be the high hydraulic pressure, and discharging the high hydraulic pressure to a high-pressure line fluid-connected to the high pressure portion;

a high-pressure regulator valve fluid-connected to the high pressure line and controlling the high hydraulic pressure supplied from the high-pressure hydraulic pump through the high-pressure line and the low hydraulic pressure supplied from the low-pressure hydraulic pump through the switch valve to be stable hydraulic pressure, and supplying the stable hydraulic pressure to the high pressure portion; and a second input line connecting the oil pan to the first low-pressure line, wherein the low-pressure regulator valve is controlled by elastic force of an elastic member disposed at a first side thereof and the low hydraulic pressure of the second low-pressure line supplied to a second side thereof, wherein the high-pressure regulator valve is selectively connected to the first low-pressure line through the switch valve and is directly fluid-connected to the high-pressure line, and wherein the high-pressure regulator valve supplies through a supply line a portion of the low hydraulic pressure supplied from the first low-pressure line or a portion of the high hydraulic pressure from the high-pressure line, to the low pressure portion.

2. The hydraulic pressure supply system of claim 1, wherein the low-pressure hydraulic pump is a mechanical hydraulic pump driven by an engine, and the high-pressure hydraulic pump is an electric hydraulic pump driven by an electric motor.

3. The hydraulic pressure supply system of claim 1, wherein the switch valve is controlled by control pressure of a first solenoid valve being an on/off solenoid valve.

4. The hydraulic pressure supply system of claim 1, wherein the switch valve is provided with one inflow port and two outflow ports, and is configured to selectively supply the low hydraulic pressure supplied to the inflow port to any one of the two outflow ports.

5. The hydraulic pressure supply system of claim 4, wherein the one inflow port is fluid-connected to the first low pressure line and each of the two outflow ports is fluid-connected to the second low pressure line and the high pressure line respectively.

6. The hydraulic pressure supply system of claim 1, wherein the low-pressure regulator valve recirculates through a first recirculation line a portion of the low hydraulic pressure supplied from the first low-pressure line so as to control the low hydraulic pressure of the first low-pressure line to be the stable low hydraulic pressure, and supplies the stable low hydraulic pressure to the second low-pressure line.

7. The hydraulic pressure supply system of claim 6, wherein the first recirculation line fluid-connects the low-pressure regulator valve with the first input line.

8. The hydraulic pressure supply system of claim 1, wherein the high-pressure regulator valve and the switch valve are fluid-connected by the high pressure line.

9. The hydraulic pressure supply system of claim 1, wherein the supply line fluid-connects the high-pressure regulator valve with the third low-pressure line.

10. The hydraulic pressure supply system of claim 3, wherein the high-pressure regulator valve is controlled by control pressure of a second solenoid valve, elastic force of an elastic member, and the low hydraulic pressure of the first low-pressure line or the high hydraulic pressure of the high-pressure line wherein a hydraulic pressure of the high-pressure line counteracts the control pressure of the second solenoid valve.

11. The hydraulic pressure supply system of claim 10, wherein the second solenoid valve is a proportional control solenoid valve.

12. The hydraulic pressure supply system of claim 1, wherein a check valve for preventing back flow is mounted on the second input line.

* * * * *